United States Patent [19]

Colburn

[11] 4,234,990

[45] Nov. 25, 1980

[54] SURFBOARD ANKLE LEASH QUICK RELEASE

[76] Inventor: Constantine W. Colburn, 533 Venezia Ave., Venice, Calif. 90291

[21] Appl. No.: 926,655

[22] Filed: Jul. 21, 1978

[51] Int. Cl.[3] ..... A63C 15/06

[52] U.S. Cl. ..... 9/310 A; 9/310 E; 59/86; 403/157

[58] Field of Search ..... 9/310 E, 310 AA; 24/201 LP; 59/86, 93; 403/157, 289, 252, 254, 161; 294/78 R, 82 R; 114/113, 114, 39, 102, 230

[56] References Cited

U.S. PATENT DOCUMENTS

| | | | |
|---|---|---|---|
| 362,548 | 5/1887 | Smith | 403/252 |
| 1,419,974 | 6/1922 | McLaughlin | 59/86 |
| 3,802,011 | 4/1974 | Castagnola | 9/310 E |
| 3,931,656 | 1/1976 | Thompson | 9/310 E |
| 3,967,572 | 7/1976 | Lea | 114/230 |
| 4,041,562 | 8/1977 | Nealy | 9/310 AA |
| 4,044,415 | 8/1977 | Wood | 9/310 E |

*Primary Examiner*—Trygve M. Blix
*Assistant Examiner*—D. W. Keen
*Attorney, Agent, or Firm*—Ralph B Pastoriza

[57] ABSTRACT

A tether line is connected between a surfboard and an ankle cuff about a surfer's ankle so that the surfer will not lose the surfboard if he becomes separated from the board. A quick release is provided between the one end of the tether line and the ankle cuff permitting the surfer to manually release the tether line from the ankle cuff in an emergency situation. The quick release includes a yoke member to which the tether line is secured arranged to straddle an opening in the ankle cuff. A pin passes through the arms of the fork and the opening in the cuff and by simply manually removing the pin, the quick release results.

6 Claims, 6 Drawing Figures

SURFBOARD ANKLE LEASH QUICK RELEASE

BACKGROUND OF THE INVENTION

This invention relates generally to surfboards with tether lines and more particularly to a surfboard ankle leash tether line having a quick release.

It is known to provide a tether line connected between a surfboard and a surfer so that should the surfer become separated from the board, he can retrieve the board fairly quickly by means of the tether line. Generally, these lines are connected at one end to the surfboard and at the other end to an ankle cuff worn about one of the surfer's ankles. Sufficient slack is provided in the tether line so as not to interfere with the surfer's proper control of the surfboard.

Ankle cuffs presently used by surfers to which the tether line is attached may take the form of a cloth-like material including "VELCRO" end portions which can be overlapped to secure the material about the surfer's ankle. This ankle cuff includes a grommet reinforced opening through which a tether line may be passed to secure the tether line to the cuff. The other end of the line connects to the surfboard.

With the foregoing arrangement, should a surfer become separated from his board during normal surfing operations, he can, as pointed out above readily retrieve the surfboard. On the other hand, should there arise an abnormal or emergency situation in which being "tethered" to the board could be dangerous, it would be desirable to provide a means whereby the surfer could release himself from the board and tether line relatively quickly. Where "VELCRO" type attachments are provided for the cuff, the surfer could attempt to simply peel apart the "VELCRO" secured portions to remove the entire cuff. However, there is grave danger of the surfer becoming injured by the tethered surfboard during the time taken to unravel the cuff.

SUMMARY OF THE INVENTION

The present invention contemplates the provision of a surfboard ankle leash quick release device for enabling a surfer to very rapidly disengage himself from a tether line and surfboard in an abnormal emergency situation.

More particularly, in accord with the present invention, there is provided the usual tether line connected at one end to the surfboard. A yoke member in turn is connected to the other end of the tether line and is designed to straddle the usual grommet reinforced opening in the ankle leash or cuff. A pin in turn passes through the yoke and opening so that a surfer will not lose the surfboard should he become separated from the board under normal conditions. On the other hand, the surfer can, at his option, quickly disconnect the tether line from the ankle cuff by manually removing the pin to free himself from the board and tether line in an abnormal emergency situation.

BRIEF DESCRIPTION OF THE DRAWINGS

A better understanding of this invention will be had by now referring to the accompanying drawings in which.

DETAILED DESCRIPTION OF THE PREFERRED EMBODIMENTS

Figure 1:
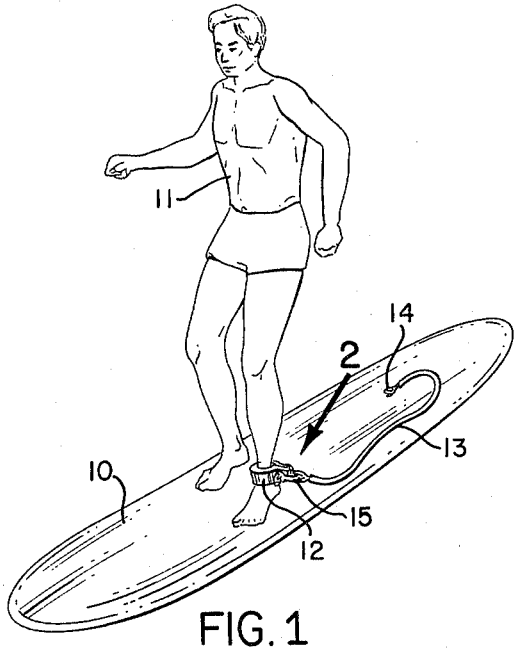
FIG. 1 is a perspective view of a surfer on a surfboard utilizing a tether line with the quick release device all in accord with the present invention.

Referring first to FIG. 1, there is illustrated a typical surfboard 10 and surfer 11 riding the board. An ankle leash in the form of an ankle cuff 12 and tether line 13 is provided, one end of the tether line 13 being connected to the surfboard as at 14 and the other end connected to the cuff 12 by means of a quick release device designated generally at 15.

As described heretofore, the above arrangement will enable a surfer to quickly retrieve his surfboard should he become separated therefrom in normal surfing activities. The present invention in the form of a quick release device in combination with the tether line will enable the surfer to quickly disengage the tether line from the ankle cuff in order to free himself completely from the surfboard and tether line in the event of an abnormal emergency situation.

Figure 2:
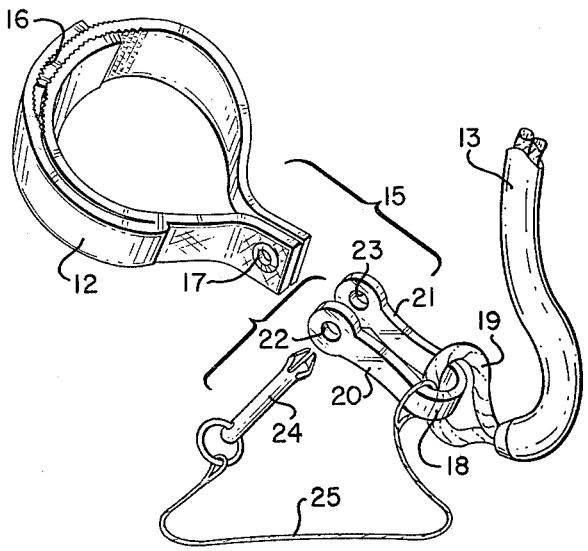
FIG. 2 is a greatly enlarged exploded perspective view of the basic components making up the surfboard ankle leash quick release.

Referring now to FIG. 2, details of the quick release device will be described. As shown, the ankle cuff 12 is in the form of a band of cloth material which may be simply wrapped about the ankle of the surfer and secured in the position by overlapping ends of the band which include a "VELCRO" type of material 16 to hold the band in secure position. The cuff itself includes a grommet reinforced connecting eye 17 to which the tether line 13 has in the past normally been secured.

In accord with the present invention, the quick release device 15 serves to connect the tether line 13 to the reinforced connecting eye 17 and includes a yoke member 18. The free end of the tether line 13 extending from the surfboard is secured to the yoke member as shown at 19. The yoke member itself includes arms 20 and 21 having aligned pin receiving means 22 and 23 positioned to straddle the eye 17 in the ankle cuff 12. In the embodiment shown in FIG. 2, these pin receiving means comprise openings for receiving a pin 24. Pin 24 in turn is connected by way of a flexible line 25 to the yoke member 18 to prevent losing of the pin. As will become clearer as the description proceeds, the flexible line 25 also serves as a convenient means for grasping by the surfer to pull the pin from the yoke and thus quickly release the tether line 13 from the ankle cuff 12.

Figure 3:
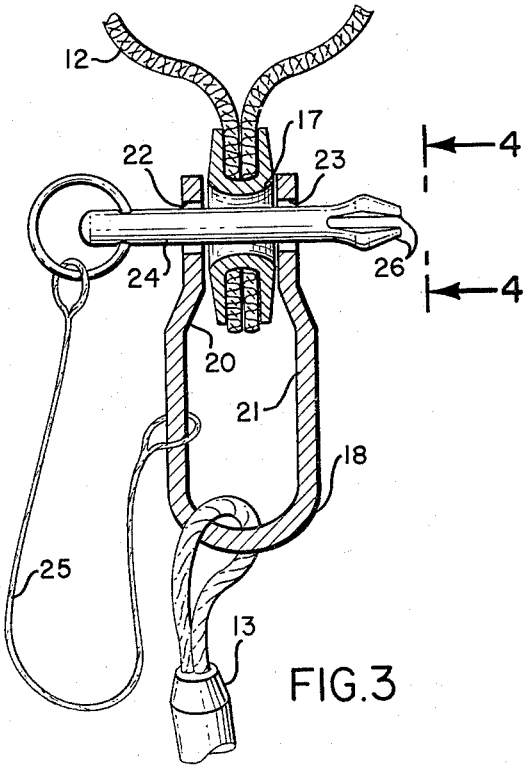
FIG. 3 is a cross-section of certain portions of the quick release mechanism in its normal connected relationship.

All of the foregoing can better be understood by now referring to the assembled view of FIG. 3 wherein it will be noted the pin 24 has been received through the first pin receiving opening 22 in the arm 20 of the yoke 18 and thence through the grommet reinforced opening 17 in the cuff 12 and finally through the aligned pin receiving opening 23 in the other arm 21 of the yoke. The dimensioning of the pin is such that it will easily extend through the aligned openings as described with the far end of the pin protruding from the furthest opening 23.

In accord with a feature of this invention, there is provided a means for retaining the pin 24 in position and yet so designed as to permit easy removal of the pin by manual manipulation. In FIG. 3, this means takes the form of end fingers 26 on the pin biased radially outwardly but collapsible radially inwardly when a direct pull is effected on the pin to remove it from the yoke.

Figure 4:
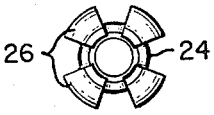
FIG. 4 is an end view of one of the components taken in the direction of the arrows 4—4 of FIG. 3.

FIG. 4 illustrates an end view of the fingers 26 which may be formed by counter-boring the end of the pin and then slotting the counter-bore wall to define the fingers. These fingers may be bent radially outwardly slightly so that they will engage the opening 23 on the yoke arm and prevent inadvertent dropping out of the pin 24. On the other hand, when a pull is exerted on the pin by the surfer as by grasping the flexible line 25, the pulling force is sufficient to collapse the fingers and permit the pin to easily move out of the various aligned openings and thereby release the yoke from the ankle cuff.

Figure 5:
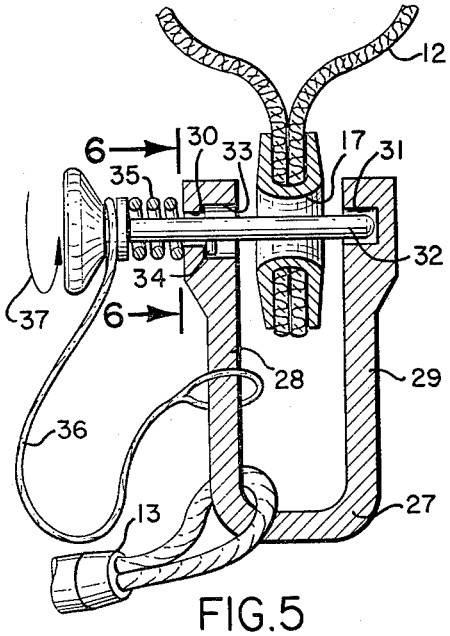
FIG. 5 is another cross section similar to that of FIG. 3 illustrating a modified type of quick release connector.

Referring now to FIG. 5, there is shown a second embodiment of the invention wherein a modified yoke and pin structure is used. Thus, in FIG. 5, the yoke is illustrated at 27 comprised of arms 28 and 29 having pin receiving means 30 and 31 arranged to straddle the grommet reinforced opening or eye 17 in the ankle cuff 12. A pin 32 is shown passing through the pin receiving means 30 which is in the form of an opening and into the second pin receiving means 31 which is in the form of a cavity in the arm 29.

Pin receiving means in the form of the opening 30 includes an increased diameter opening 33 which defines an annular step facing the grommet reinforced eye 17 of the cuff 12. A lateral projection 34 is formed on the pin 32 and rests on this annular step defined by the increased diameter opening 33. A small compression spring 35 is positioned to bias the pin 32 in a generally outward direction to hold the projection 34 seated on the annular seat and thus serves as the means for retaining the pin 32 in position in the absence of intentional manual manipulation thereof. As in the case of the structure of FIGS. 2 and 3, a flexible line 36 connects the pin 32 to the yoke 27.

Removal of the pin 32 in the embodiment of FIG. 5 in an emergency situation is accomplished by the surfer simply rotating the pin in the direction, for example, of the arrow 37 to align the lateral projection 34 with an appropriate slot formed in the opening 30 and through the annular step defined by the increased diameter opening 33.

Figure 6:
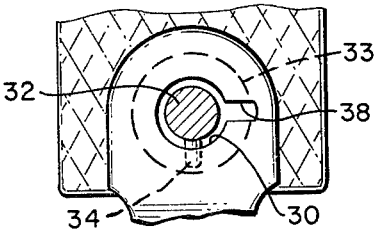
FIG. 6 is a fragmentary cross section taken in the direction of the arrows 6—6 of FIG. 5.

With specific reference to FIG. 6, the referred to slot is illustrated at 38, the projection 34 and the increased diameter opening 33 being illustrated in phantom lines. Thus, from FIG. 6 it will be clear that when the pin 32 is rotated 90° in a counterclockwise direction as viewed in FIG. 6, the lateral projection 34 will be aligned with the slot 38 so that the spring 35 described in FIG. 5 will simply pop out the pin so that the same is readily removed from the aligned openings to free the cuff 12 from the yoke 27.

In both embodiments described, the pin is always held to the yoke by means of the flexible line 25 or 36 and thus the pin and yoke can be provided as a separate structure readily adaptable to presently available tether lines and ankle cuff structures. In other words, it is only necessary for a person to purchase the yoke and pin structure and then simply disconnect the tether line from the reinforced eye or opening 17 of the cuff and reconnect it to the yoke 27. The yoke arms can then straddle the opening 17 of the cuff and the pin can be inserted to provide the desired connection. As described heretofore, the flexible line 25 or 36 not only serves to secure the pin to the yoke so that it will not become lost but also permits the surfer to readily grasp the pin and pull the same by means of the line in the embodiment of FIG. 3 or readily locate the pin by grasping the line 36 in the embodiment of FIG. 5 for quick rotation thereof to release the same.

While the yoke structure is illustrated in cross section as metal in FIGS. 3 and 5, a plastic yoke material could be used.

From the foregoing description, it will thus be evident that the present invention has provided a simple and reliable surfboard ankle leash quick release permitting a surfer to completely disengage himself from a tether line and surfboard in abnormal emergency situations.

I claim:

1. A surfboard ankle leash quick release including, in combination:

(a) an ankle cuff for securement about a surfer's ankle said ankle cuff having a connecting eye;

(b) a tether line having one end for connection to said surfboard;

(c) a yoke member connected to the other end of said tether line and straddling said eye in said ankle cuff; and (d) a pin passing in said yoke through said eye so that a surfer will not lose the surfboard should he become separated from the board under normal conditions but can, at his option, quickly disconnect the tether line from the ankle cuff by manually removing said pin to free himself from the board and tether line in an abnormal emergency situation.

2. A quick release according to claim 1, including a flexible line connecting said pin to said yoke to prevent losing said pin and also serve as a convenient means for grasping by the surfer in pulling said pin from said yoke.

3. A surfboard ankle leash quick release including, in combination:

(a) an ankle cuff for securement about a surfer's ankle and including a connecting eye;

(b) a tether line for connection to said surfboard;

(c) a quick release for connecting the other end of the tether line to said connecting eye on said ankle cuff so that a surfer will not lose the surfboard should he become separated from the board under normal conditions but can, at his option, quickly disconnect the tether line from the ankle cuff to free himself from the board in an abnormal emergency situation, said quick release including:

(1) a yoke member connected to said other end of said tether line and having arms with aligned pin receiving means for straddling said eye of said cuff;

(2) a pin dimensioned to pass through the pin receiving means on one yoke arm, and thence through said connecting eye of said ankle cuff into the pin receiving means on the other yoke arm; and (3) a flexible line connecting said pin to said yoke to prevent losing the pin, whereby the surfer can quickly manually remove said pin from said yoke in said abnormal emergency situation to thereby release said tether line from said ankle cuff.

4. A quick release according to claim 3, in which said pin includes means for retaining said pin in position to said yoke in the absence of the surfer manually manipulating the pin to remove the same.

5. A quick release according to claim 4, in which said pin receiving means in the arms of the yoke comprises openings through which said pin passes, said means for retaining said pin in position being defined by end fingers on the pin biased radially outwardly but collapsible radially inwardly when a direct pull is effected on the pin to remove it from said yoke, said flexible line connecting said pin to the yoke serving as a convenient means for grasping by the surfer to pull said pin.

6. A quick release according to claim 4, in which said pin receiving means on said one yoke arm comprises an opening and said pin receiving means on the other yoke arm comprises a cavity receiving the end of the pin, said opening having an increased diameter portion defining an annular step facing said connecting eye, said means for retaining said pin in position including a lateral projection on the pin overlying said annular step, and a spring biasing said pin outwardly, said step having a slot extending through said opening through which said projection can pass when said pin is rotated to align the projection with said slot, said spring popping said pin out through said opening to thereby release said yoke from said ankle cuff.

* * * * *